US011022941B2

(12) United States Patent
Baebler et al.

(10) Patent No.: US 11,022,941 B2
(45) Date of Patent: Jun. 1, 2021

(54) TIMEPIECE CASE WITH PUSH-PIECE

(71) Applicant: Harry Winston SA, Plan-les-Ouates (CH)

(72) Inventors: Jean Baebler, Guemligen (CH); Johnny Buehler, Luins (CH)

(73) Assignee: Harry Winston SA, Plan-les-Ouates (CH)

( * ) Notice: Subject to any disclaimer, the term of this patent is extended or adjusted under 35 U.S.C. 154(b) by 323 days.

(21) Appl. No.: 16/174,619

(22) Filed: Oct. 30, 2018

(65) Prior Publication Data

US 2019/0171163 A1 Jun. 6, 2019

(30) Foreign Application Priority Data

Nov. 22, 2017 (EP) ..... 17203115
Mar. 21, 2018 (CH) ..... 00381/18

(51) Int. Cl.
*G04B 3/04* (2006.01)

(52) U.S. Cl.
CPC ..... *G04B 3/046* (2013.01); *G04B 3/041* (2013.01); *G04B 3/048* (2013.01)

(58) Field of Classification Search
CPC ..... G04B 3/046; G04B 3/041; G04B 3/048; G04B 27/004; G04B 23/021; G04F 7/0895
USPC ..... 368/319
See application file for complete search history.

(56) References Cited

U.S. PATENT DOCUMENTS 3,837,162 A * 9/1974 Meitinger ..... G04B 19/25 368/185
6,918,694 B2 * 7/2005 Speichinger ..... G04B 27/001 368/184
9,557,715 B2 * 1/2017 Goldmann ..... G04B 21/12
2004/0090872 A1 5/2004 Schmiedchen
2008/0159081 A1 7/2008 Laucella et al.

FOREIGN PATENT DOCUMENTS

| | | |
|---|---|---|
| CH | 703 455 A1 | 1/2012 |
| EP | 1 939 699 A1 | 7/2008 |
| FR | 2 995 414 | 3/2014 |
| WO | WO 02/077723 A1 | 10/2002 |

OTHER PUBLICATIONS

European Search Report dated May 29, 2018 in European application 17203115.5, filed on Nov. 22, 2017 (with English Translation of Categories Cited).
Chinese Office Action dated Aug. 19, 2020 in Chinese Patent Application No. 201811391170.1, 3 pages.

* cited by examiner

*Primary Examiner* — Edwin A. Leon
(74) *Attorney, Agent, or Firm* — Oblon, McClelland, Maier & Neustadt, L.L.P.

(57) ABSTRACT

A timepiece case, including a seat which guides inside it a push-piece for supplying energy, including a control member which can be operated with pressure against resilient return device and which is integral with driving device, the push-piece or the case including a flat cam track, the case or the push-piece including a pivot about which an arm carrying a pin following the profile of this track pivots, which track includes elbows directed towards the pivot and defining stable positions of the pin and ramps arranged so that any pressure applied on the control member when it is in the rest position causes the pin to come out of its stable position and to travel, under the action of the resilient return device, towards another stable position.

20 Claims, 9 Drawing Sheets

TIMEPIECE CASE WITH PUSH-PIECE

CROSS-REFERENCE TO RELATED APPLICATION

This application claims priority to European Patent Application No. 17203115.5 filed on Nov. 22, 2017, the entire disclosure of which is hereby incorporated herein by reference.

FIELD OF THE INVENTION

The invention relates to a timepiece case, comprising at least one seat which guides inside it a push-piece for rewinding or resetting a mechanism or for supplying energy to a storage means or to a mechanism or a user circuit, the said push-piece being movable along a unique rectilinear trajectory against resilient return means and comprising a control member which is arranged to be operated at least along the said rectilinear direction by means of pressure applied by a user against the said resilient return means and which is integral with driving means.

The invention also concerns a timepiece, in particular a watch, comprising such a case and having an input wheel which cooperates with a mechanism or a means for converting and/or storing energy.

BACKGROUND OF THE INVENTION

Rewinding small-size watches using the crown is often awkward, in particular in the case of ladies watches or ultra-slim watches. If the user has long fingernails this operation is made even more difficult.

SUMMARY OF THE INVENTION

The invention proposes providing a more ergonomic rewinding system for small-size watches which may also be suitable for performing other functions of a watch, such as activating a timer or a minute repeater, changing a spindle, or the like, while occupying a minimum amount of space inside the watch case.

For this purpose, the invention relates to a timepiece case according to claim 1.

The invention also relates to a timepiece, in particular a watch, comprising such a case.

BRIEF DESCRIPTION OF THE DRAWINGS

Further characteristic features and advantages of the invention will become clear from reading of the detailed description which is provided below with reference to the attached figures in which:

FIG. 2 shows the push-piece at rest;

FIG. 3 shows the push-piece in an unstable position on travel path A described in FIG. 7;

FIG. 4 shows the push-piece in a stable position on travel path B described in FIG. 7;

FIG. 5 shows the push-piece in an unstable position on travel path C described in FIG. 7;

FIG. 6 shows the push-piece in a stable position on travel path D described in FIG. 7;

FIG. 9 shows a view, from above, of the watch case in which a cover, shown in transparent form, encloses the push-piece mechanism according to the invention and where a connecting plate joins the part operated by the user to the internal mechanism, a pivoting arm of which cooperates with a jumper housed on the side of the case;

FIG. 10 is similar to FIG. 9, the cover and the connecting plate having been disassembled;

FIG. 11 is a close-up view of the connecting plate zone;

FIG. 12 shows, from below, the guiding system for a flat plate with the rack and the cam track;

FIG. 13 shows the pivoting arm and its rear zone which makes contact with the jumper;

FIG. 14 shows the connecting plate;

FIG. 15 shows, from above, the flat plate with the rack and the cam track, which comprises a first support lug for guiding the spring and on which the connecting plate is fixed;

FIG. 16 is a detail of assembly of the control member with the connecting plate;

FIG. 17 shows the retention of the spring at its two ends by support lugs, one of which is integral with the flat plate and the other one of which is mounted in the case;

FIG. 18 shows a perspective view of the flat plate from above;

FIG. 19 shows a perspective view of the flat plate from below;

FIG. 20 shows the bottom of the case configured to receive this push-piece;

FIG. 21 shows a view, from above, of the watch case in which a cover, shown in transparent form, encloses the push-piece mechanism according to the invention and where a connecting plate joins the part operated by the user to the internal mechanism, a pivoting arm of which cooperates with a jumper housed on the side of the case;

FIG. 22 is similar to FIG. 21 the cover and the connecting plate having been disassembled;

FIG. 23 is a close-up view of the connecting plate zone;

FIG. 24 shows, from below, the guiding system for a flat plate with the rack and the cam track;

FIG. 25 shows the pivoting arm and its rear zone which makes contact with the jumper;

FIG. 26 shows the connecting plate;

FIG. 27 shows, from above, the flat plate with the rack and the cam track, which comprises a first support lug for guiding the spring and on which the connecting plate is fixed;

FIG. 28 is a detail of assembly of the control member with the connecting plate;

FIG. 29 shows the retention of the spring at its two ends by support lugs, one of which is integral with the flat plate and the other one of which is mounted in the case;

FIG. 30 shows a perspective view of the flat plate from above;

FIG. 31 shows a perspective view of the flat plate from below; and

FIG. 32 shows the bottom of the case configured to receive this push-piece.

DETAILED DESCRIPTION OF PREFERRED EMBODIMENTS

Figure 1:
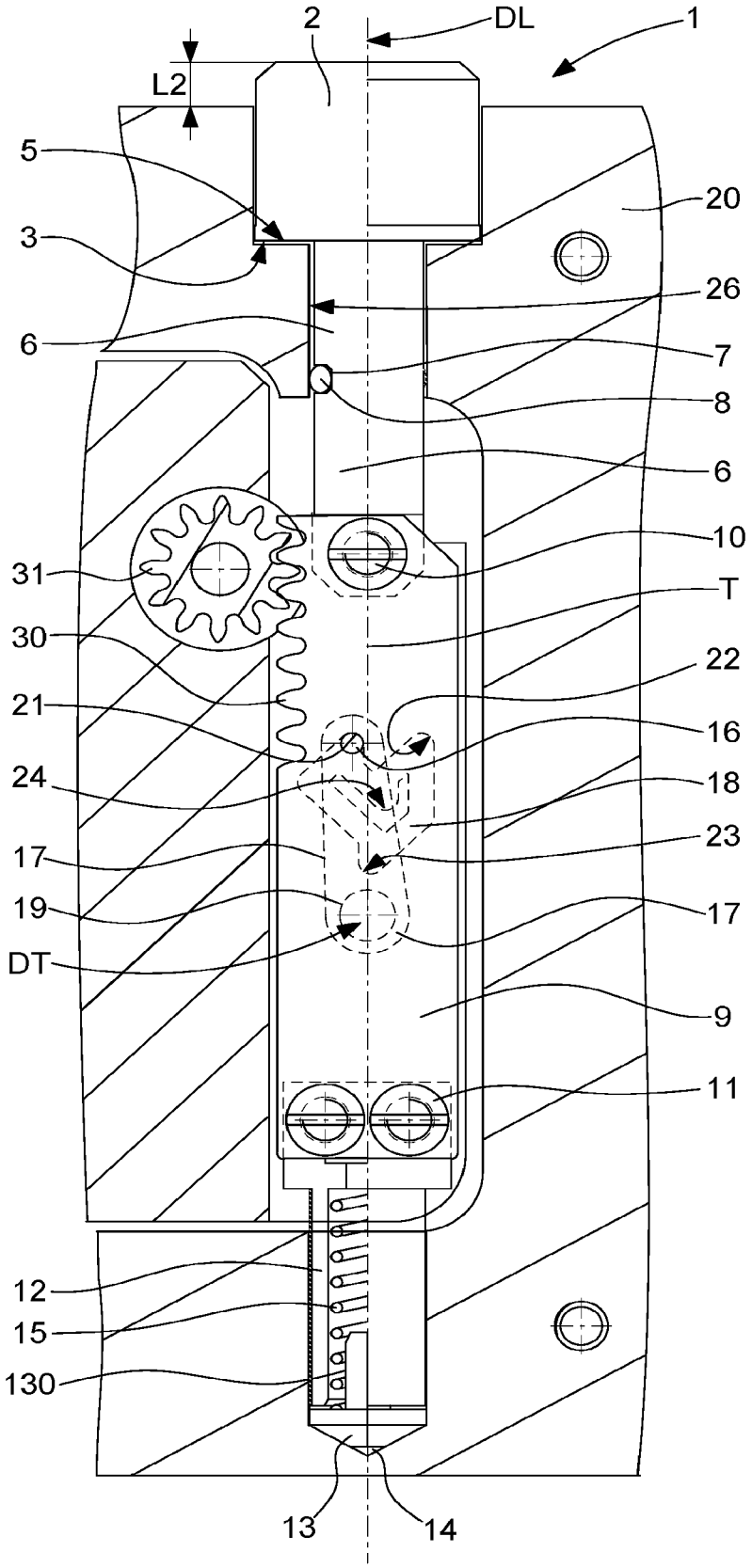
FIG. 1 shows, in partial schematic form and longitudinally sectioned along an axis of the push-piece, a watch case and its push-piece according to the invention, in a particular non-limiting variant where the push-piece has a linear travel path.

The invention relates to case 20 of a timepiece, in particular a watch.

This case 20 comprises at least one seat 26 which guides inside it a push-piece 1, in particular and in a non-limiting manner, for rewinding or resetting a mechanism, or for supplying energy to a storage means or to a mechanism or a user circuit.

This push-piece 1 is movable, along a unique rectilinear trajectory, against resilient return means 15 and comprises a control member 2, such as a crown or the like, which is arranged to be operated at least along the rectilinear trajectory by means of pressure applied by a user against the resilient return means 15.

In variants, not shown, the control member 2 may be operated by means of pivoting or may comprise a coaxial secondary member which can be operated translatably and/or by means of pivoting.

This control member 2 is integral with driving means 30 so as to provide movement and/or energy for the consumer function of the timepiece.

According to the invention, the push-piece 1, or respectively the case 20, comprises a closed and flat cam track 18. Also the case 20, or respectively the push-piece 1, comprises, at the end of an arm 17 pivoting about a pivot 19 fixed to the case 20 or respectively to the push-piece 1, a guide pin 16 which is arranged to follow the profile of the cam track 18.

This pivoting arm 17 is designed to pivot in a plane parallel to that of the cam track 18.

The cam track 18 comprises at least two elbows directed towards the pivot 19 and defining stable positions 23, 24 of the guide pin 16, which correspond to stable positions of the control member 2.

The invention is illustrated in a non-limiting manner in the figures, with two such elbows and two stable positions.

The profile of the cam track 18 comprises ramps, which are arranged so that any pressure applied on the control member 2, when it is in the rest position—each rest position corresponding to a stable position 23, 24—causes the guide pin 16 to come out of this stable position 23, 24 and allows it to travel, under the action of the resilient return means 15, towards another stable position 24, 23.

More particularly, the profile of the cam track 18 is arranged to force the guide pin 16 to follow a travel path in one direction only along the cam track 18.

Figure 7:
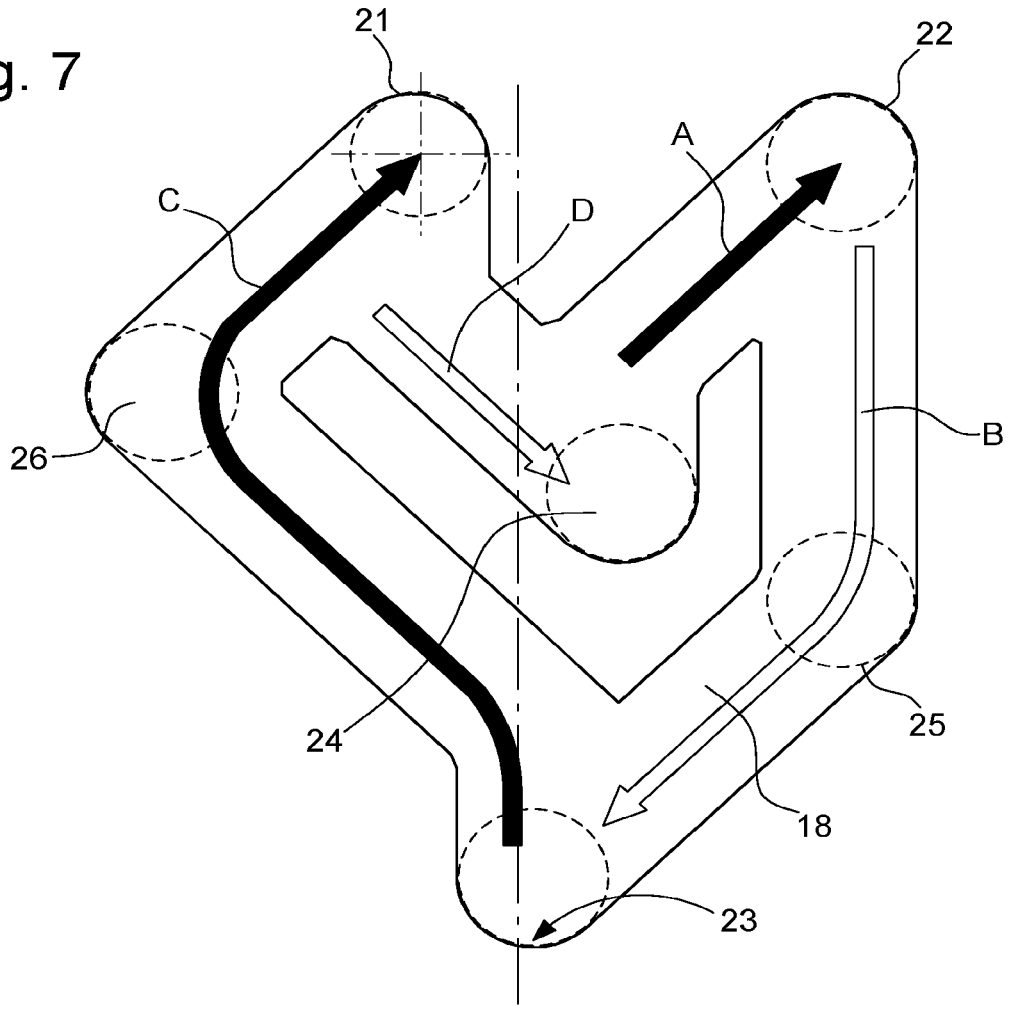
FIG. 7 shows a plan view of the detail of a cam track comprised in the push-piece according to the preceding figures and arranged to allow the travel movement of a guide pin positioned at the end of a hinged arm pivoting about a pivot fixed to the case.
Figure 8:
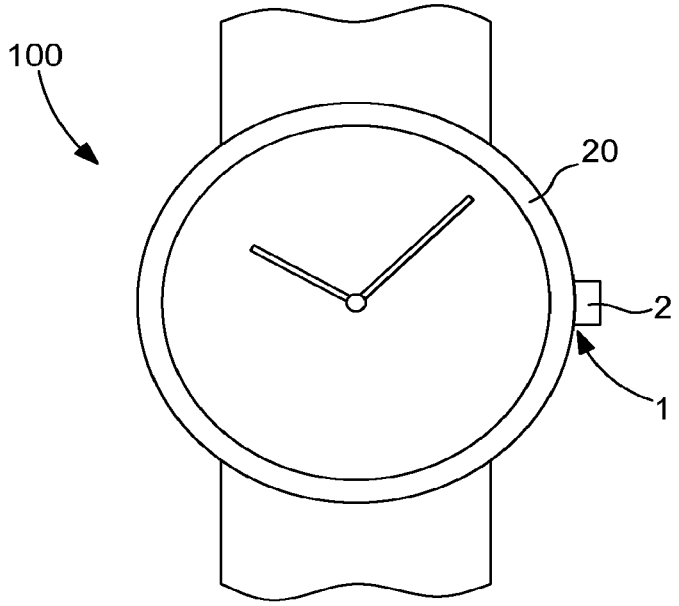
FIG. 8 shows a plan view of watch comprising such a case.
Figure 9:
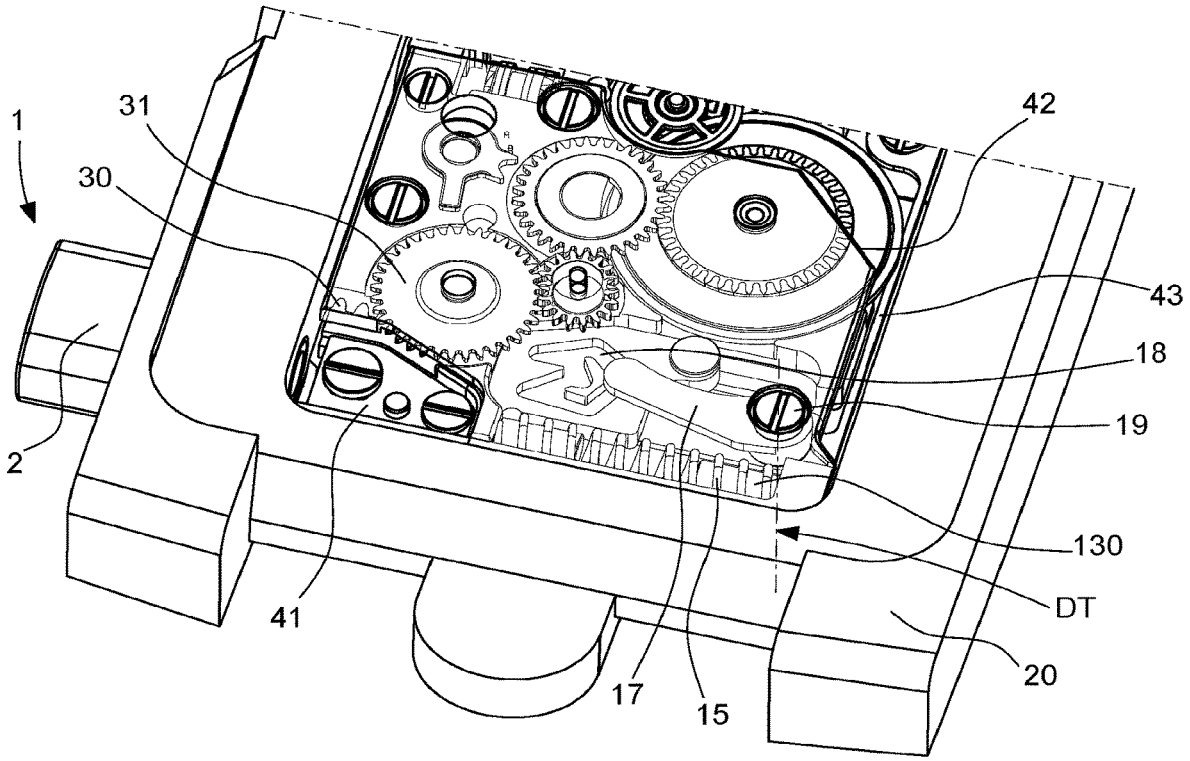
FIGS. 9 to 20 show a perspective view of the details of another constructional design based on the same principle as that of FIGS. 1 to 8.
Figure 10:
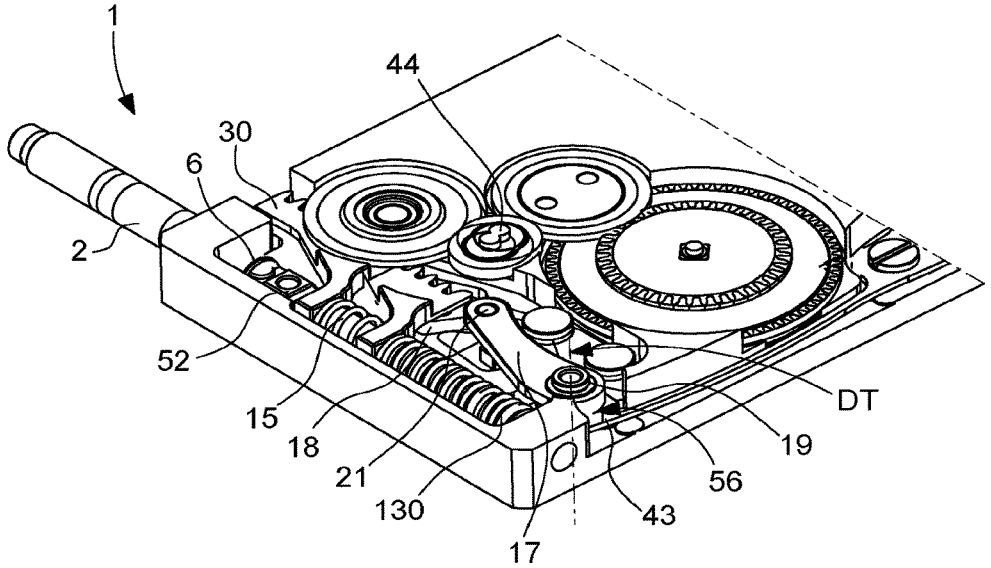
Figure 11:
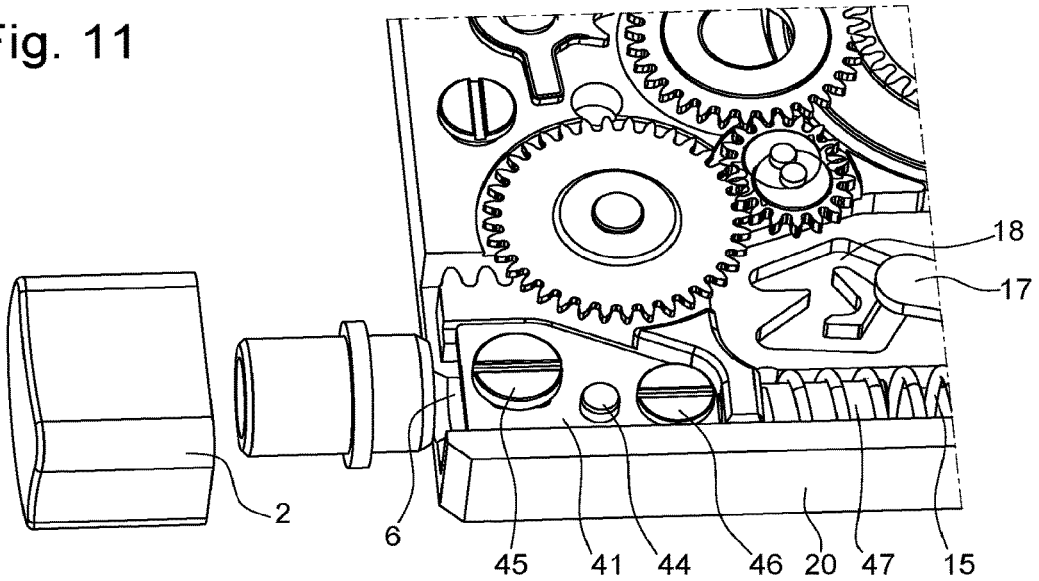
Figure 13:
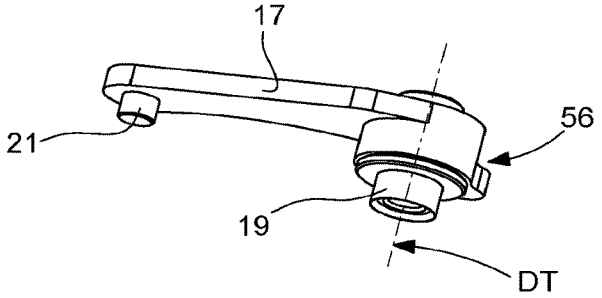
Figure 12:
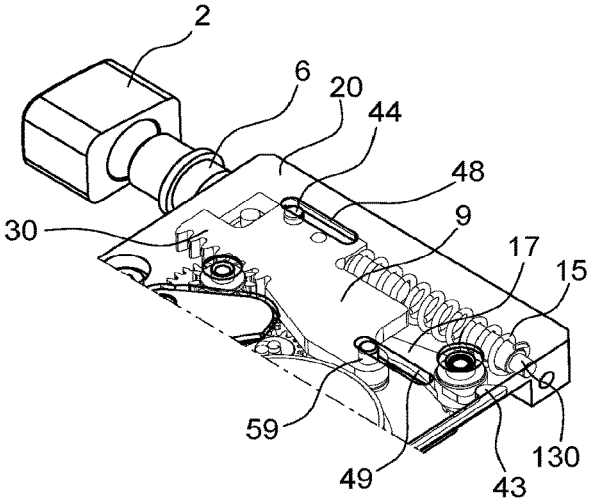
Figure 14:
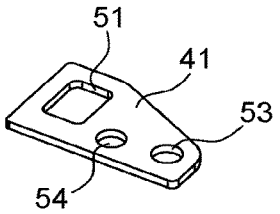
Figure 15:
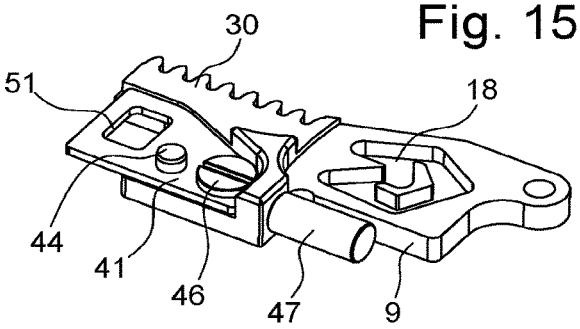
Figure 16:
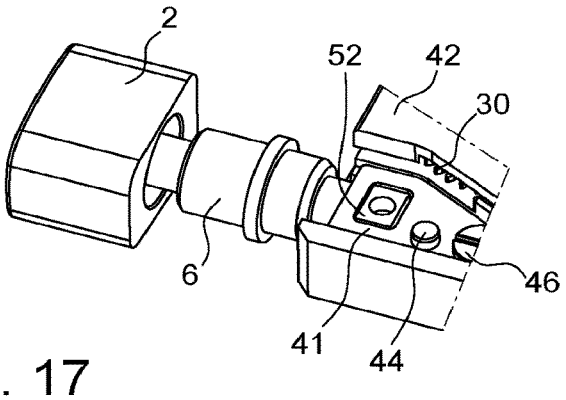
Figure 17:
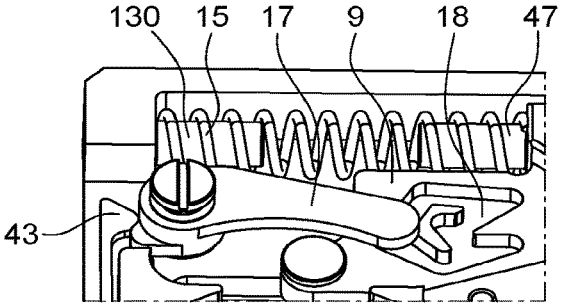
Figure 18:
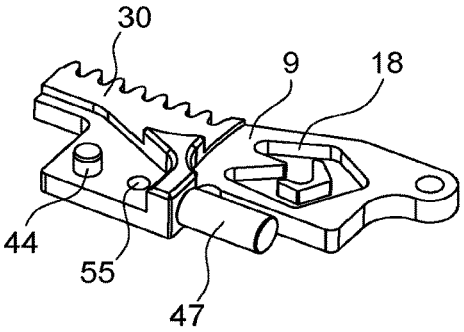
Figure 19:
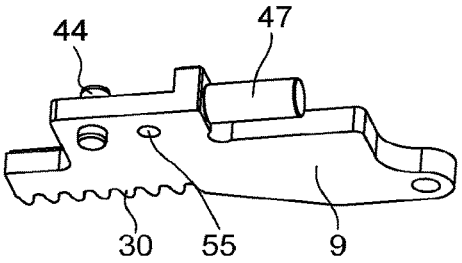
Figure 20:
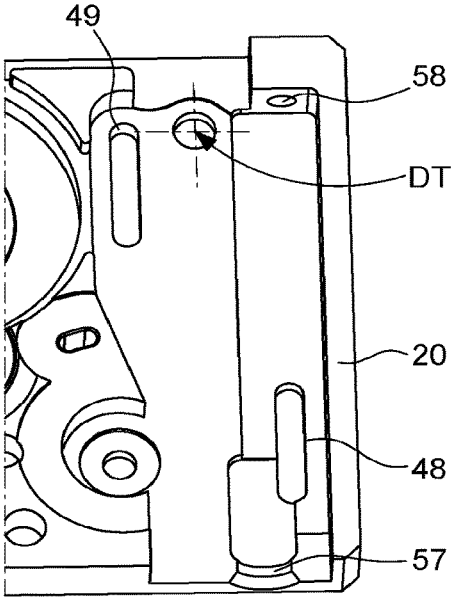
Figure 21:
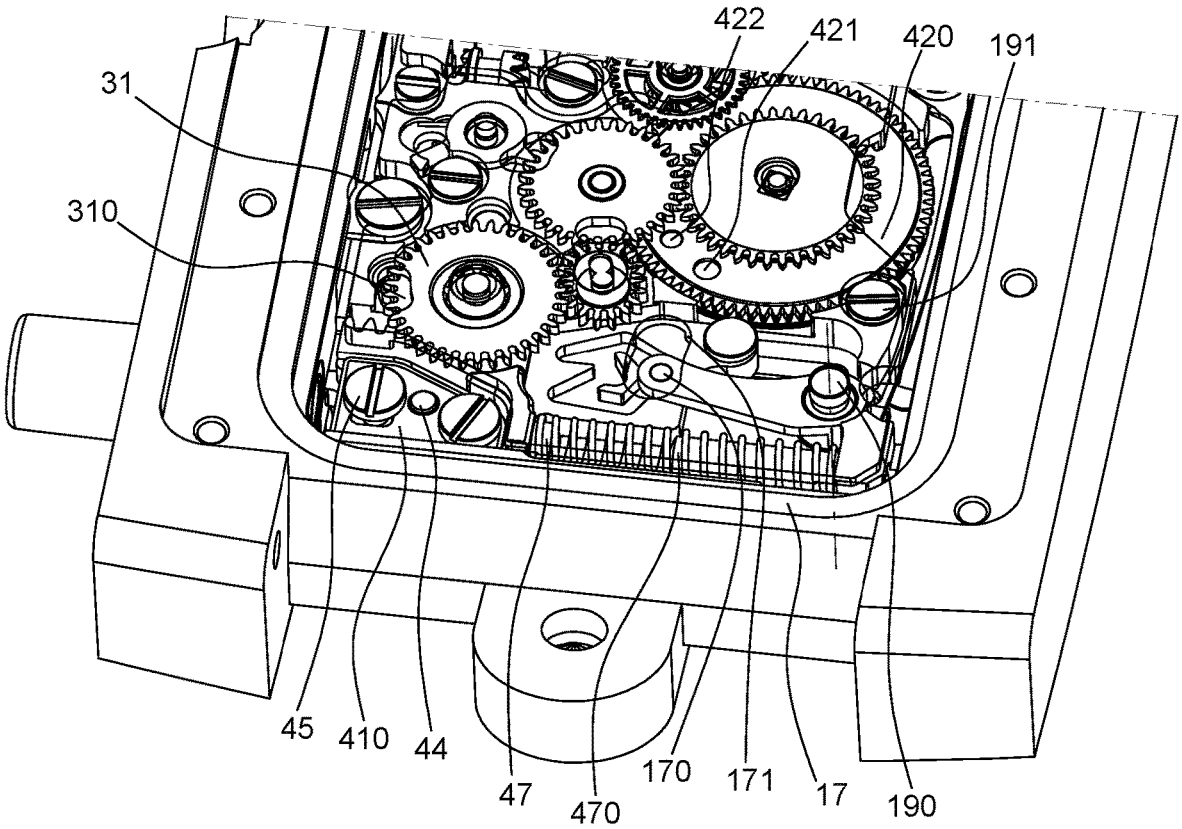
FIGS. 21 to 32 show, in a similar manner to FIGS. 9 to 20, a variant of an improved watch case for facilitating assembly and adjustment.
Figure 22:
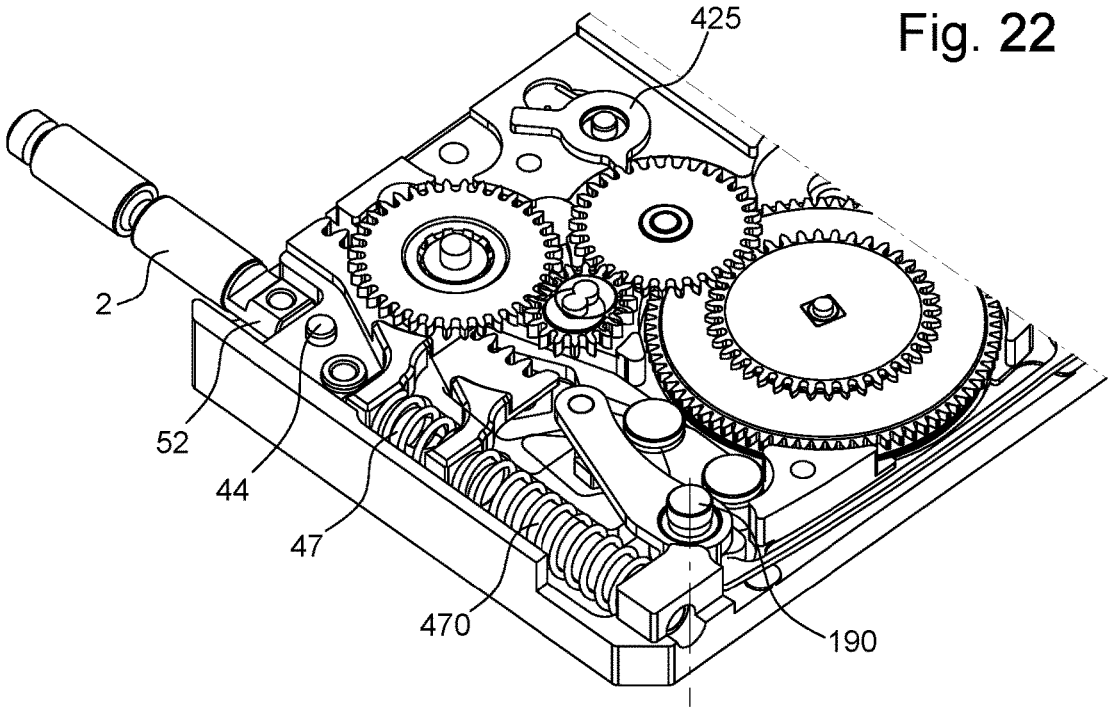
Figure 23:
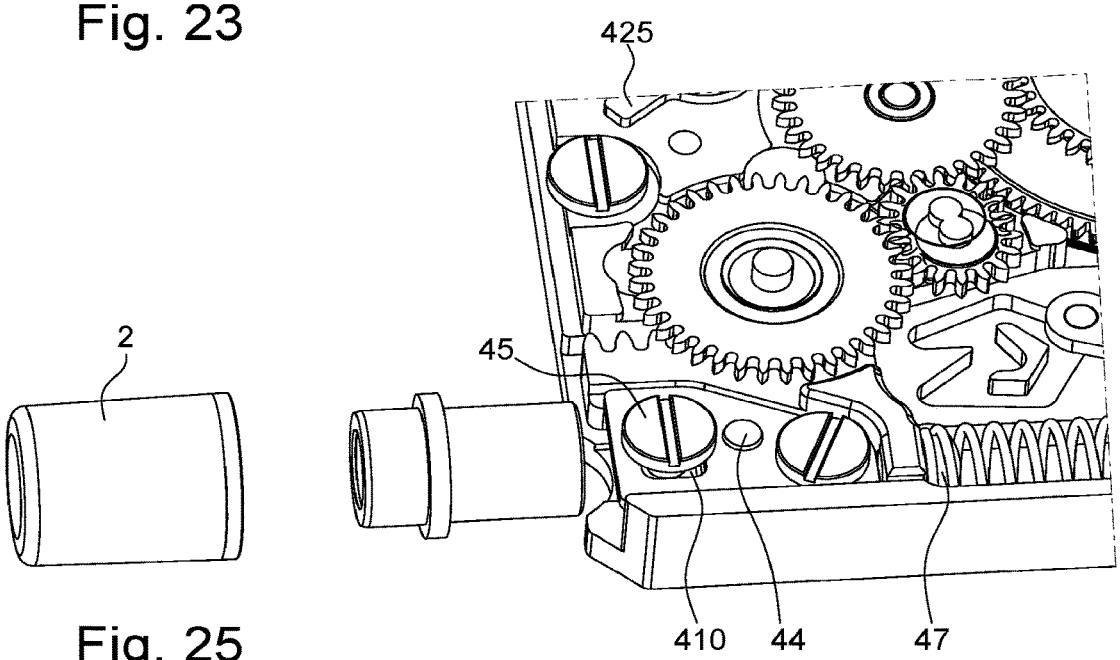
Figure 25:
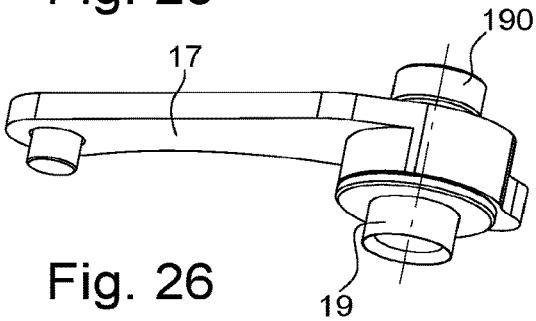
Figure 26:
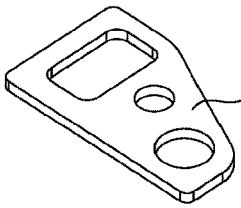
Figure 24:
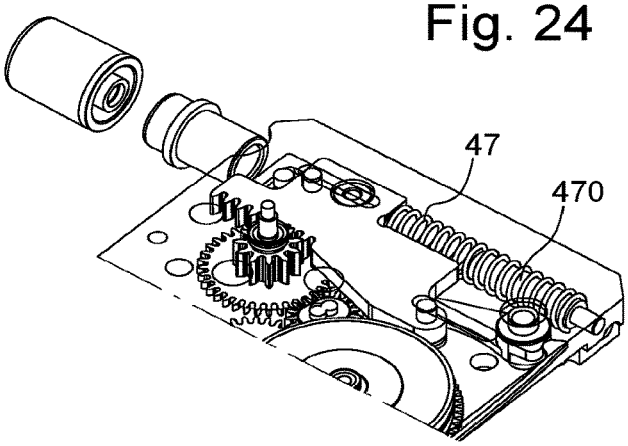
Figure 27:
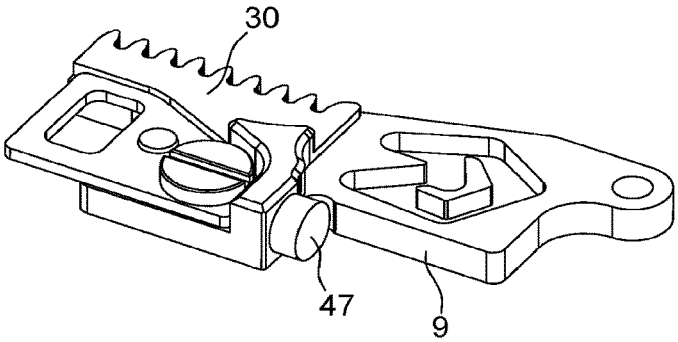
Figure 28:
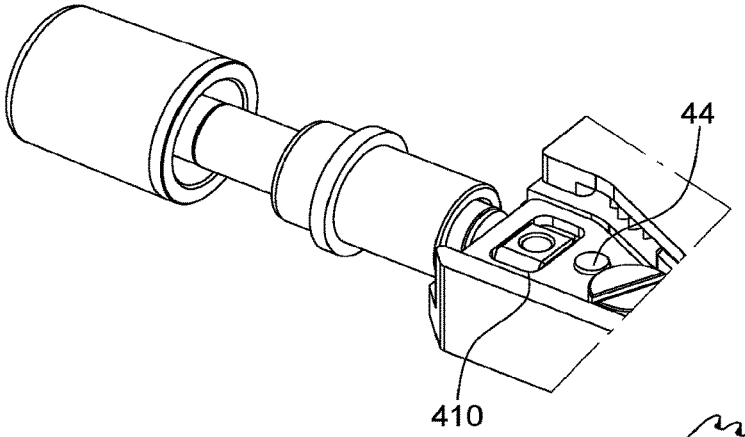
Figure 30:
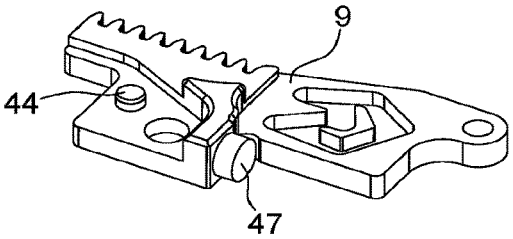
Figure 29:
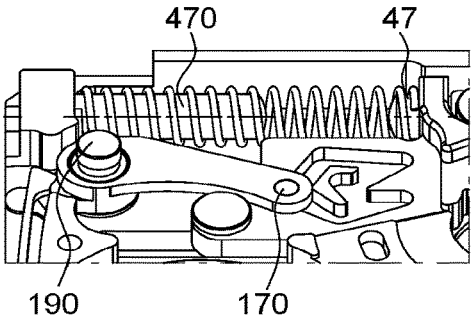
Figure 31:
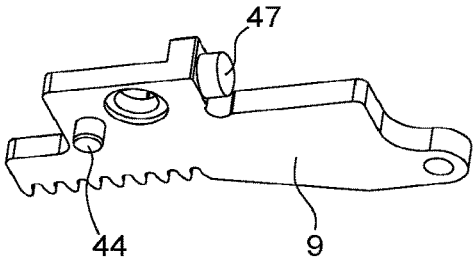
Figure 32:
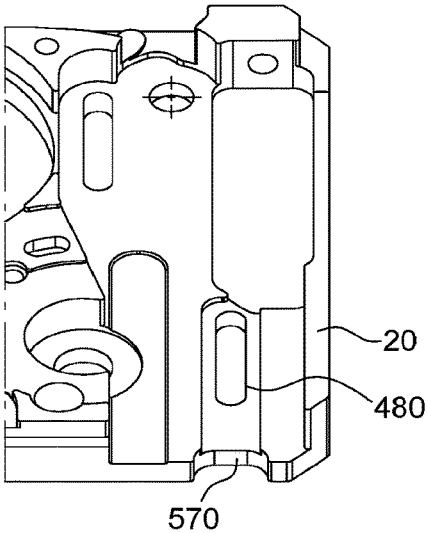

Advantageously, in order to facilitate the changes in position of the guide pin 16 in relation to the cam track 18 during movements relative to each other, these at least two elbows are offset transversely in relation to the pivot 19 along the trajectory, as can be seen in FIG. 7.

This FIG. 7 shows a particular non-limiting embodiment where the cam track 18 comprises:

- between a first stable position 23 corresponding to an axial end of the travel path of the push-piece 1 and a first unstable position 21, a first section C which the guide pin 16 travels along following pressure applied by the user on the control member 2;
- between the first unstable position 21 and a second stable position 24, a second section D which the guide pin 16 travels along under the action of the resilient return means 15;
- between the second stable position 24 and a second unstable position 22 a third section A which the guide pin 16 travels along following pressure applied by the user on the control member 2;
- between the second unstable position 22 and the first stable position 23, a fourth section B which the guide pin 16 travels along under the action of the resilient return means 15.

Figure 2:
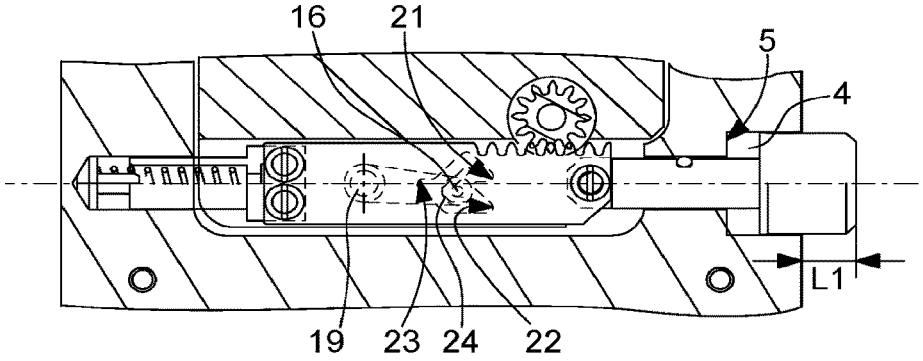
FIGS. 2 to 6 show, in a similar manner to FIG. 1, a complete kinematic operating cycle of this push-piece.
Figure 3:
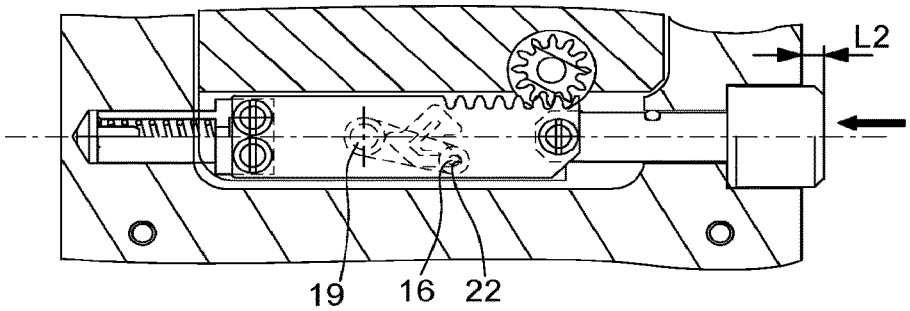
Figure 4:
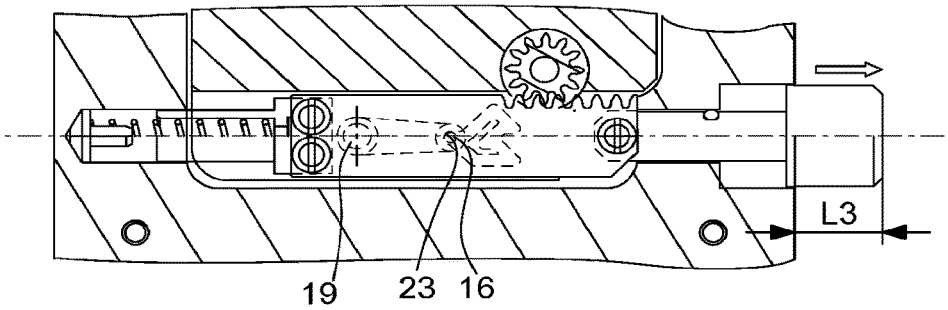
Figure 5:
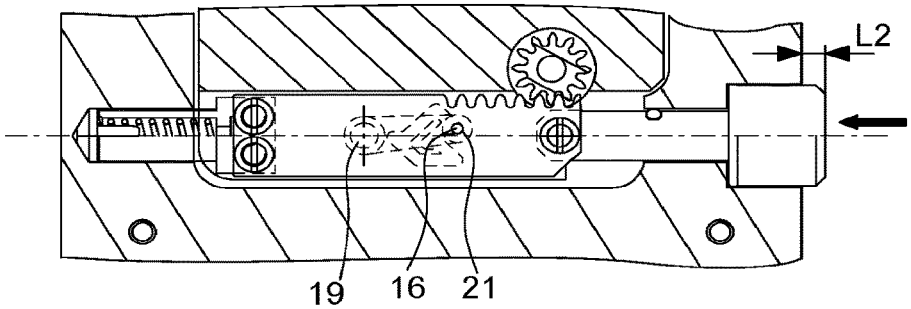
Figure 6:
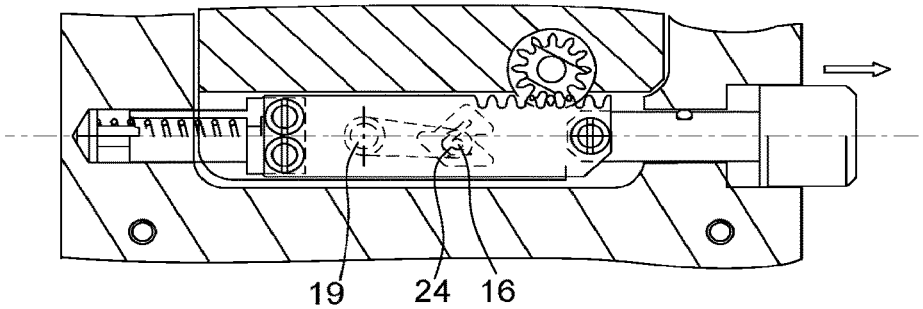

The black arrows in the figure corresponding to the travel paths C and A indicate the movements following pressure applied by the user on the control member 2, while the white arrows corresponding to the travel paths D and B indicate the movements performed under the action of the resilient return means 15. The same is also applicable to FIGS. 3 to 6, which illustrate respectively, from the rest position shown in FIG. 2, the different travel paths A, B, C and D. The two stable positions of the push-piece 1 correspond to elongations L1 and L3 of the end of the control member 2 in relation to a reference surface of the case 20, while the unstable transitory positions shown in FIGS. 3 and 5 correspond to an elongation L2 (which could have values different from each other depending on the form of the profile of the cam track 18 which, in the example shown in FIG. 7, has the same longitudinal spacing between the first stable position 23 and the first unstable position 21, on the one hand, and between the first stable position 23 and the second unstable position 22 on the other hand; but this spacing could also be different. In FIG. 7, the section C comprises two ramps in opposite directions, with an inflexion position 26, and the section B comprises a straight part followed by a ramp after passing through an inflexion position 25.

More particularly, the pivoting arm 17 is freely pivoting, its pivoting movement resulting from the relative positioning of the cam track 18 and the pivot 19 during the relative travel of one in relation to the other.

More particularly, the rectilinear trajectory is flat, as in the case of the figures.

Even more particularly, the rectilinear trajectory follows a linear direction DL.

More particularly, the driving means 30 comprise at least one rack arranged to cooperate with an input wheel 31 which the case 20 comprises.

In other variants not shown, these driving means may be a simple finger actuating a rocker arm or the like, a friction element, a spring, or the like.

More particularly, for an economic design illustrated in the figures, the resilient return means 15 comprise at least one helical spring which is housed inside a chamber or inside a tube 12 housed inside a bore of the case 29 and bearing frontally against a stop 13 comprising an axial guide for the spring. In the variant shown, FIG. 1 shows such a tube 12 inside a bore of the case 20, this tube 12 being integral with an angle bracket fixed by screws 11 to a structural element of the push-piece 1; the tube 12 preferably has a bore or the like for evacuating the air. The stop 13 shown in the figures consists, in a non-limiting manner, of a stopper which is seated inside the bore of the case and which comprises an internal axial guide for the spring. Another variant consists in seating the spring in a front groove formed in the case 20. In the variant where the trajectory of the push-piece is linear, it is important to ensure correct alignment between the control member 2 and the tube 12.

More particularly, the push-piece 1 comprises a substantially flat plate 9 which has formed therein the cam track 18 and which constitutes such a structural element and which is fixed by another screw 10 to the control member 2.

More particularly, the push-piece 1 comprises, in the region of this control member 2, a cylindrical part 6 which has at least one groove 7 for receiving at least one seal 8 which makes contact, along the whole of the travel path of the push-piece 1, with a cylindrical bore formed in the seat 26 of the case 20.

FIGS. 9 to 21 show another constructional variant which has a slightly greater number of components, since it has been arranged for easier assembly and disassembly.

This non-limiting variant comprises, in order to improve the stability of the pivoting lever 17, a bistable spring which is a jumper 43 acting on a rear profile 56 of the pivoting lever 17, which rear profile 56 is has a substantially male V shape.

Other alternative solutions may also be convenient for improving the stability of the pivoting lever 17: friction by means of a polymer gasket or the like along the axis, indentation, the insertion of a metal foil, a lateral friction spring, a bistable spring.

The driving means 30 also comprise here a rack. A single component, in the form of a substantially flat plate 9, incorporates this rack 30, the cam track 18 and a first support lug 47 for guiding the resilient return means 15 which comprise in this case also at least one helical spring. The latter is guided at its other end by a second support lug 130, seated inside a bore 58 of the case 20. The plate 9 again comprises a pin 44, which extends on either side of a flat part of the plate 9 and which is perpendicular to the first support lug 47 which extends in the plane of the case 20. A seat 55 is intended to receive a peg or a screw 46 for fixing a connecting plate 41, through a hole 53 which is formed in the latter, onto the plate 9 positioned by the pin 44 inside a bore 54 of the connecting plate 41.

This connecting plate 41 comprises an opening 51 with a profile complementing that of a boss 52 provided here on the end of the cylindrical part 6 of the control member 2. The opening 51 and the boss 52 are here substantially square, so as to ensure the parallel arrangement of the stem 2 of the push-piece 1 and the rack. Locking together is then performed by a screw 45 fixed inside an internal thread formed in the boss 52. The cylindrical part 2 may thus be very short and assembly is greatly facilitated.

The bottom part of the pin 44 cooperates advantageously with a first oblong groove 48 formed in the case 20. On the opposite side another pin 59 integral with the plate 9 slides inside a second oblong groove 49 of the case 20. Obviously a reverse guiding arrangement is also possible, but uses up more room.

A cover 42, or a reinforcing bridge, limits the play of the different components and in particular prevents any buckling of the spring 15.

FIGS. 21 to 30 show, in a similar manner to FIGS. 9 to 20, a variant of an improved watch case for facilitating assembly and adjustment:

- the pivoting lever 17 is modified by the addition of a support lug 190 along the extension of the pivot 19 and a bore 170 accessible via an oblong opening 171;
- the first support lug 47 is shortened, the second support lug 130 is replaced by one with an elongated design 470;
- the connecting plate 41 is modified so as to move closer together the location of the pin 44 and axis of the stem, and an elongated opening 410 replaces the opening 51;
- an aperture 310 is added and allows access to the input wheel 31;
- the corrector 425 is modified and comprises a single tooth;
- the first oblong aperture is modified with the locator 480.

The invention also relates to a timepiece, in particular a watch 100, which comprises such a case 20 and an input wheel 31 of which cooperates with a mechanism or an energy conversion and/or storage means.

In one variant, the watch 100 comprises a minute repetition mechanism operated by a push-piece 1, which forms an advantageous alternative to the usual trigger pieces.

In another variant, the watch 100 comprises at least one energy storage barrel and at least one pawl between an input wheel 31 and the at least one barrel.

In yet another variant, the watch 100 comprises a plurality of push-pieces 1.

The possibilities offered by the invention are many.

Where employed for a rewinding function, the invention greatly facilitates the operation of ladies watches, small watches, ultra-slim watches and the like.

As a result of the invention, moreover, the space occupied by the movement is reduced, in particular owing to the use of a substantially flat control mechanism.

The invention claimed is:

1. A timepiece case, comprising:

at least one seat which guides inside the seat a push-piece for rewinding or resetting a mechanism or for supplying energy to a storage means or to a mechanism or a user circuit, said push-piece being movable along a unique rectilinear trajectory against resilient return means and comprising a control member which is arranged to be operated at least along said rectilinear direction with pressure applied by a user against said resilient return means and which is integral with driving means, wherein:

said push-piece comprises a closed and flat cam track and said case comprises, at the end of an arm pivoting about a pivot fixed to said case, a guide pin arranged to follow a profile of said cam track, or said case comprises a closed and flat cam track and said push-piece comprises, at the end of the arm pivoting about the pivot fixed to said push-piece, a guide pin arranged to follow a profile of said cam track, wherein said pivoting arm is arranged to pivot in a plane parallel to that of said cam track, wherein said cam track comprises at least two elbows directed towards said pivot and defining stable positions of said guide pin corresponding to stable positions of said control member, and wherein the profile of said cam track comprises ramps arranged so that any pressure applied on said control member when it is in the rest position corresponding to said stable position causes said guide pin to come out of said stable position and allows it to travel, under the action of said resilient return means, towards another said stable position.

2. The case according to claim 1, wherein the profile of said cam track is arranged to force said guide pin to follow a travel path in one direction only along said cam track.

3. The case according to claim 1, wherein said at least two elbows are offset transversely in relation to said pivot along said trajectory.

4. The case according to claim 1, wherein said cam track comprises, between a first stable position corresponding to an axial end of the travel path of said push-piece and a first unstable position, a first section which said guide pin travels along following pressure applied by the user on said control member, between said first unstable position and a second stable position a second section which said guide pin travels along under the action of said resilient return means, between said second stable position and a second unstable position a third section which said guide pin travels along following pressure applied by the user on said control member, and between said second unstable position and said first stable position a fourth section which the guide pin travels along under the action of said resilient return means.

5. The case according to claim 1, wherein said pivoting arm is freely pivoting, its pivoting movement resulting from the relative position of said cam track and said pivot during the relative travel of one in relation to the other.

6. The case according to claim 1, wherein said pivoting arm is freely pivoting, its pivoting movement resulting from the relative position of said cam track and said pivot during the relative travel of one in relation to the other, and is subject to the bearing force of a bistable spring.

7. The case according to claim 1, wherein said rectilinear trajectory is flat.

8. The case according to claim 7, wherein said rectilinear trajectory follows a linear direction.

9. The case according to claim 1, wherein said driving means comprise at least one rack arranged to cooperate with an input wheel which said case comprises.

10. The case according to claim 1, wherein said resilient return means comprise at least one helical spring housed inside a chamber or inside a tube housed inside said case and bearing frontally against a stop comprising an axial guide for said spring.

11. The case according to claim 1, wherein said resilient return means comprise at least one helical spring housed between said case and a cover and retained at its two distal ends by a first support lug mounted integral with said driving means and a second support lug fixed to said case.

12. The case according to claim 1, wherein said push-piece comprises a substantially flat plate which incorporates a rack, said cam track and a first support lug for guiding said resilient return means.

13. The case according to claim 12, wherein said plate comprises furthermore two pins perpendicular to the plane of said case and guided inside oblong grooves formed in said case, and wherein said plate comprises fixing means for fixing a connecting plate cooperating with one end of said control member.

14. The case according to claim 13, wherein said connecting plate comprises an opening with a profile complementing that of a boss which is provided on the end of said control member and the shape of which ensures the parallel arrangement of said control member and said rack.

15. The case according to claim 1, wherein said push-piece comprises a substantially flat plate wherein said cam track is formed.

16. The case according to claim 1, wherein said push-piece comprises a cylindrical part comprising at least one groove for receiving at least one seal making contact, along the whole of the travel path of said push-piece, with a cylindrical bore which is formed in said seat of said case.

17. A watch comprising:

the case according to claim 9, said input wheel of which cooperates with the mechanism or an energy conversion and/or storage means.

18. The watch according to claim 17, wherein said watch comprises a minute repetition mechanism operated by said push-piece.

19. The watch according to claim 17, wherein said watch comprises at least one energy storage barrel and at least one pawl between said input wheel and said at least one barrel.

20. The watch according to claim 17, wherein said watch comprises a plurality of said push-pieces.

* * * * *